US005628466A

United States Patent [19]

Haack et al.

[11] Patent Number: 5,628,466

[45] Date of Patent: May 13, 1997

[54] PRESSURE BARREL FOR A MEAT GRINDER

[75] Inventors: Eberhard Haack, Halle; Michael Mössmer, Belzweilerwälde, both of Germany

[73] Assignee: Maschinenfabrik Dornhan GmbH, Dornhan, Germany

[21] Appl. No.: 392,050

[22] Filed: Feb. 22, 1995

[30] Foreign Application Priority Data

Feb. 28, 1994 [DE] Germany ..... 44 06 432.2

[51] Int. Cl.[6] ..... B02C 18/30

[52] U.S. Cl. ..... 241/82.6; 241/285.2

[58] Field of Search ..... 241/82.1, 82.6, 241/82.2, 285.2

[56] References Cited

U.S. PATENT DOCUMENTS

| | | | |
|---|---|---|---|
| 1,904,884 | 4/1933 | Royle | 241/82.1 X |
| 2,505,797 | 5/1950 | Sivertsen | 241/82.6 X |
| 2,910,726 | 11/1959 | Parshall et al. | 241/82.6 X |
| 3,734,148 | 5/1973 | McCulty | 241/82.1 |
| 3,984,056 | 10/1976 | Hartley | 241/82.1 |

FOREIGN PATENT DOCUMENTS

| | | | |
|---|---|---|---|
| 757427 | 12/1933 | France | 241/82.6 |
| 620312 | 9/1935 | Germany . | |
| 1061646 | 7/1959 | Germany . | |
| 3245414 | 6/1983 | Germany . | |
| 287661 | 3/1991 | Germany . | |
| 184286 | 5/1936 | Switzerland | 241/82.1 |

*Primary Examiner*—John M. Husar

*Attorney, Agent, or Firm*—Karl Hormann

[57] ABSTRACT

An insert of substantially cylindrical configuration made of a high-grade stainless steel web for the barrel of a meat grinder is proposed which is provided with elongate members extending the length of the body of the insert and protruding into the interior thereof. Channels thus formed between the protrusions provide support for, and improve feeding of, material moved through the insert.

26 Claims, 5 Drawing Sheets

PRESSURE BARREL FOR A MEAT GRINDER

BACKGROUND OF THE INVENTION

1. Field of the Invention

The invention, in general, relates to food processing machinery of the kind equipped with feed screws for moving material from an intake, such as a hopper, through a processing station, such as choppers, knives and the like, and, more particularly, to a novel pressure barrel for a meat grinder provided with elongate channels or grooves extending longitudinally in the interior wall surface thereof for supporting, and improving the feed motion of, the material being processed.

2. The Prior Art

Conventionally, material to be processed in meat grinders and other cutting or chopping apparatus of that kind is fed into the machine through a feed opening, preferably a hopper, and is fed to a rotary cutting or knife assembly by a feed or pressure screw which is rotatably supported within, and substantially coaxially of the pressure barrel of such machine.

Pressure barrels of this general kind are disclosed, for instance, in German patent 620,312 and patent applications DE-AS 1,061,646 and DE-OS 3,245,414.

In the known apparatus, the pressure and feed screw and the barrel of the meat grinder serve to support and feed and to some extent compress the material being processed.

To this end the screw is given a special geometric configuration and is provided with flights of predetermined geometrical configurations and with additional elements, such as wedge-shaped gaps (Spaltkeile), further improving the action.

Reference is made to (East) German specification DD 287 661 which discloses a pressure barrel complementing such screws, the interior wall surface of which is specially configured by channels or grooves for purposes of further improvement in the actions referred to supra. These channels are intended to impart to the material the support necessary for feeding.

The best-known channels in such barrels are of rectangular cross-section and extend in the direction of the longitudinal axis of the barrel. However, rifled or helical channels are also utilized in pressure barrels. The edges of the channels may be rounded.

The pressure barrels are manufactured in different ways. For instance, they may be cast, welded or mechanically milled. In current manufacturing techniques the channels are formed in the same manner as the barrels, which is expensive or inefficient in terms of both material and labor.

OBJECTS OF THE INVENTION

It is an object of the invention to provide a pressure barrel of the kind which satisfies the requirements of through-feed and cutting or chopping.

A further object of the invention is to provide a barrel which may be replaced or exchanged to accommodate different operating conditions.

A still further object of the invention is to provide a pressure barrel which precludes material abrasion.

Yet another object of the invention is to provide a pressure barrel precluding contamination of material in process.

It is also an object of the invention to provide a pressure barrel which may easily be cleaned to guaranty high standards of sanitation and hygiene.

Other objects will in part be obvious and will in part appear hereinafter.

SUMMARY OF THE INVENTION

The invention, in a preferred embodiment, provides for a pressure barrel of a meat grinder having an interior substantially cylindrical wall provided with elongate protrusions forming channels between them. Preferably, the protrusions extend along the length of the wall and are of uniform width. They may be of straight configuration extending substantially parallel to the axis of the barrel. In an alternate embodiment, the protrusions extend in a helical manner. They may be integral with the interior wall of the barrel. Alternatively, they may be formed as beads cold-formed in a flat metal web before it is shaped into a complete cylinder or into semi-cylindrical matching shells which together make up a cylinder. In another embodiment, the elongate protrusion may comprise staves extending between annular members. Mating members are preferably provided in the barrel and the insert to prevent rotation of the insert during operation of the assembly.

The pressure barrel in accordance with the invention comprising a basic component and a support system providing an insert with a channeled interior surface removably mounted therein results from the realization that the feeding and cutting actions in a meat grinder are depending to a substantial degree upon the configuration of the pressure barrel.

The basic component or pressure barrel is made from conventional materials whereas the insert is preferably made from a high-grade stainless steels such as, for example, a chromium-nickel-alloy steel. Other materials, such as titanium steels, may, of course also be used to suit special applications. It is important that the material chosen is such that the surface condition of the pressure barrel satisfies modern standards of sanitation and hygiene, as defined, for instance in Rz 25.

The support system insert is made from a flat metal web cold-formed to provide beads therein and thereafter rolled into a cylindrical shape in the interior surface of which the beads form protrusions forming channels between them.

The basic component or barrel may similarly be made from flat web material, such as Cr-Ni-steel with beading cold-formed therein and subsequently shaped into a cylinder from the interior wall surface of which the beading protrudes as a series of elongate protrusions forming channels between them.

The barrel insert may, in a preferred embodiment of the invention, comprise two matching semi-shells provided with elongate protrusions. When assembled the semishells will form a cylinder suited for insertion into a pressure barrel of a meat grinder.

In yet another embodiment of the invention, the insert comprises a cage-like member made up of a plurality of straight or helically extending staves affixed at their ends to rings.

When mounted within the barrel of a meat grinder such cage-like insert will provide the grooves cooperating with the smooth interior walls of the barrel for improved feeding and supporting of the material being processed.

The support system essentially absorbs axial thrust forces and the interior wall of the barrel acts as the bottom of a groove absorbing forces radially surrounding the material. The combined effect of the support system, i.e. the cage-like insert, and the barrel results in improved overall performance of pressure barrel and feed screw.

The insert is preferably positively connected to the barrel to ensure, on the one hand, an easy removability or exchangeability and, on the other hand, its secure placement and alignment within the barrel.

The apparatus in accordance with the invention makes it possible to provide basic components or barrels of relatively simple structure and to augment them with inserts of the kind herein defined selected on the basis of the number, shape and size of their channels to satisfy given operating conditions.

Thus, the apparatus in accordance with the invention advantageously provides for the adaptability of shape and arrangement of the channels and the exchangeability of the insert to suit particular operating conditions, the avoidance of abrasion in the barrel and, hence, contamination of material being processed, simple manufacture and high standards of cleanliness.

BRIEF DESCRIPTION OF THE SEVERAL DRAWINGS

The novel features which are considered to be characteristic of the invention are set forth with particularity in the appended claims. The invention itself, however, in respect of its structure, construction and lay-out as well as manufacturing techniques, together with other objects and advantages thereof, will be best understood from the following description of preferred embodiments when read in connection with the appended drawings, in which:

DETAILED DESCRIPTION OF THE INVENTION

Figure 1:
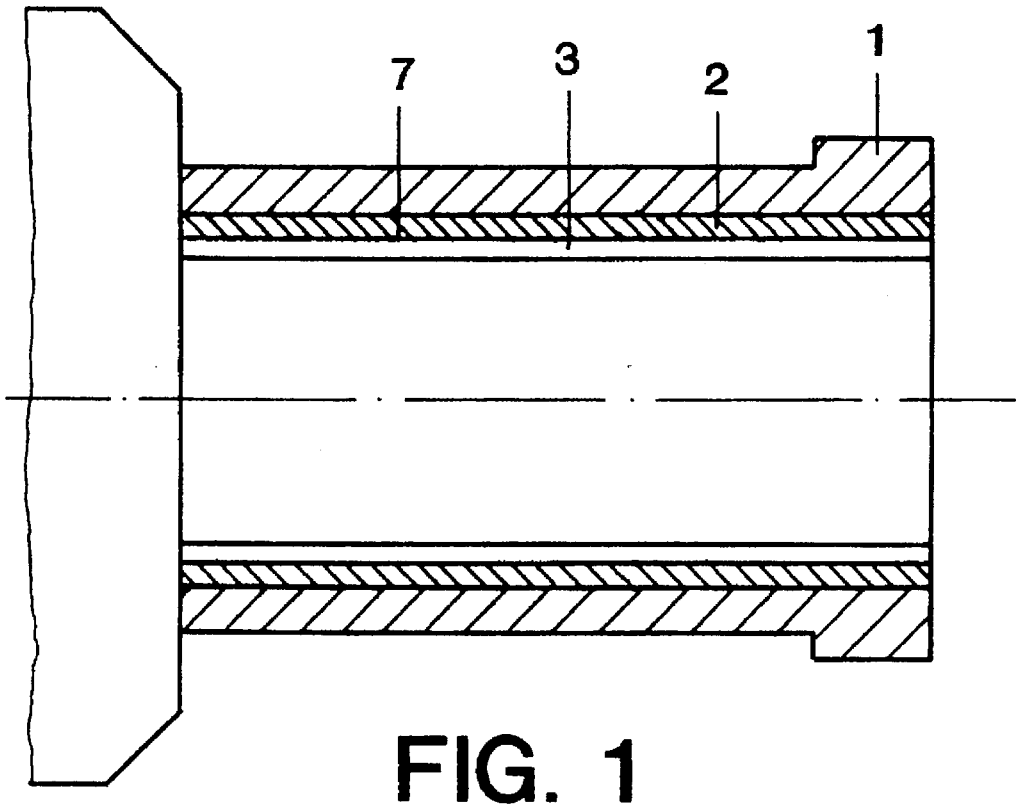
FIG. 1 is a view in longitudinal section of a barrel insert inserted in the barrel of a meat grinder.

As shown in FIG. 1, a support system 7 in accordance with the invention is removably or exchangeably mounted within the basic body of a meat grinder 1, the support system 7 being formed as an insert 2 in the pressure barrel.

The basic component for manufacturing the insert 2 preferably is a flat metal web member 5 (FIG. 2) made of a high-grade stainless steel alloyed with chromium, titanium or nickel.

The flat web member 5 is subjected to a cold-forming process to form beads 6 therein. The beads 6 are made so that, when the web 5 is formed into an insert of cylindrical configuration, they extend longitudinally along the interior wall of the insert 2 to form between them channels 3 in the interior wall.

Figure 2:
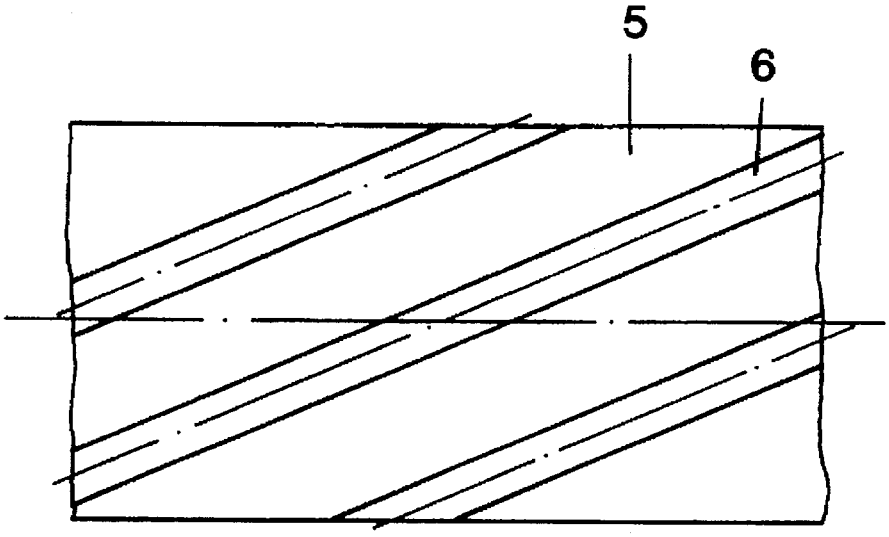
FIG. 2 is a flattened surface rendition of a pressure barrel insert in accordance with the invention.

FIG. 2 shows a portion of the web 5 provided with obliquely extending beads 6 which would form rifled or helically extending channels 3 in the barrel insert 2.

Figure 4:
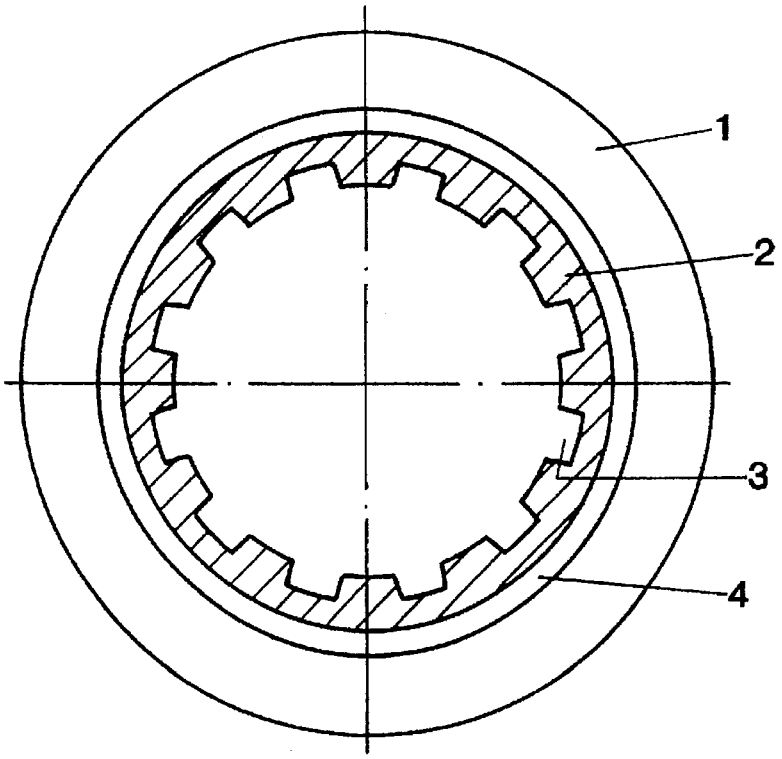
FIG. 4 is another cross-sectional view of a pressure barrel with an insert spaced therefrom by an annular gap.

FIG. 4 depicts an advantageous embodiment of the seat of an insert 2 within the barrel 1. In this embodiment, there is provided an annular gap 4 between the interior wall of the barrel 1 and the outer wall of the insert 2.

The gap 4 serves to provide additional cooling to any material being processed in the insert, by allowing a cooling medium to be fed into it which may directly affect the material as the thickness of the wall of the insert 2 of about 1–3 mm provides for a good heat exchange.

The gap 4 may, however, also be used for installing and arranging predetermined functional elements, such as sensors for monitoring existing operating conditions. Signals derived by the sensors may be fed to a central control for evaluation and for providing signals for adjusting the process within, and operation of, the meat grinder.

Figure 3:
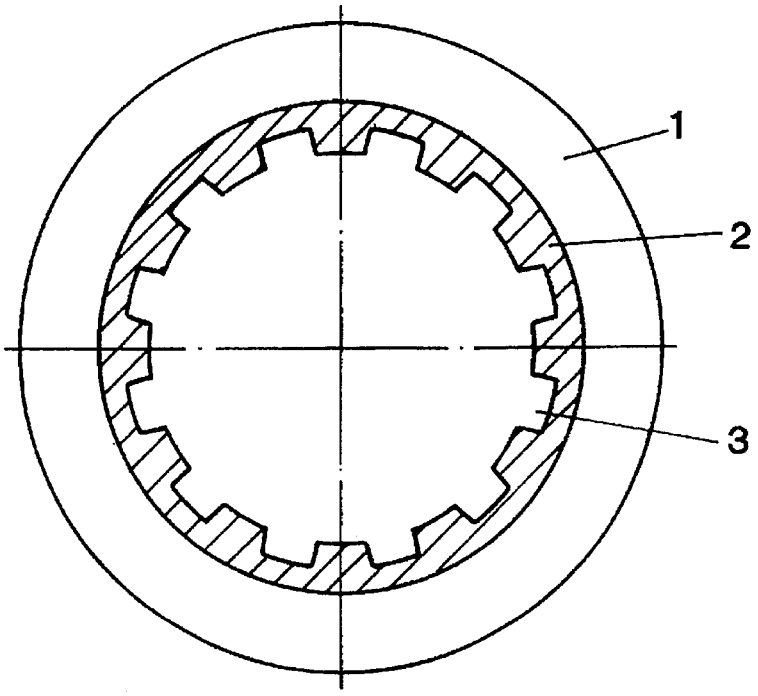
FIG. 3 is a cross-sectional view of the embodiment of FIG. 1.

As shown in FIG. 3, the cold-forming of beads 6 in the web material 5, which is efficient in terms of manufacturing and costs, makes it possible to form channels 3 of many different cross-sectional configurations which in turn affect the feeding and processing of any material in process.

The barrel insert 2 may also be formed of individual segments. It is believed that an insert made up of two semi-shells 8 is most advantageous in terms of manufacturing, utilization and sanitation.

Figure 5:
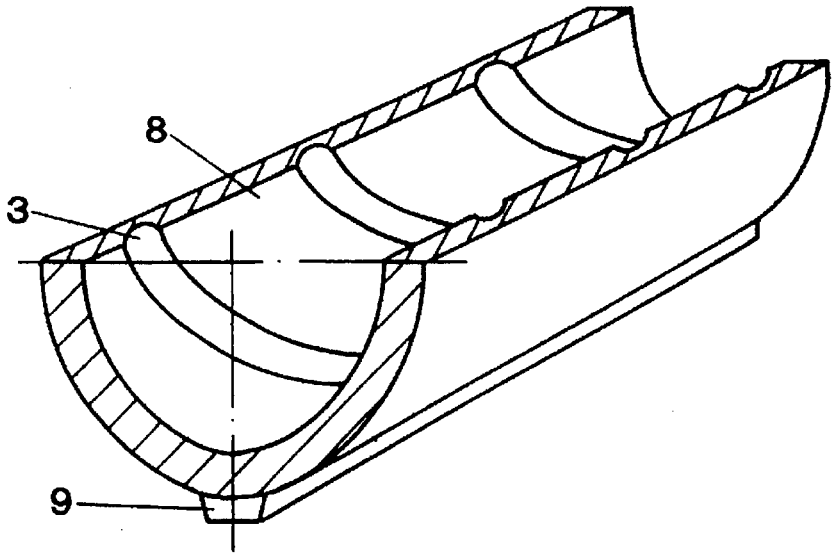
FIG. 5 is a perspective view of half a shell of a barrel insert in accordance with the invention.

The semi-shell 8 depicted in FIG. 5 is provided with integral channels 3, and, when matched with a second semi-shell, constitutes a complete barrel insert 2 which may be inserted into a barrel 1 in this assembled condition.

The semi-shells 8 may be secured to each other and against rotation relative to the barrel 1 of the meat grinder by a strip 9, preferably made of high-grade stainless steel, which in turn may be placed into a groove 10 provided in the interior wall of the cavity in barrel 1, and by the mutual engagement of their free elongate edge surfaces.

Securing the insert against axial displacement is accomplished at one end by the insert 2 abutting against an end surface of the barrel 1 and, at the other end, by a sleeve nut which at the same time secures the cutting set within the grinder.

This embodiment provides for a secure seating of the insert 2 within the barrel 1, and at the same time it makes it easy to remove or exchange the insert 2 since their are no additional retainers.

In large meat grinders an ejector customarily provided in such machines, may be used for removal of the insert 2.

Figure 6:
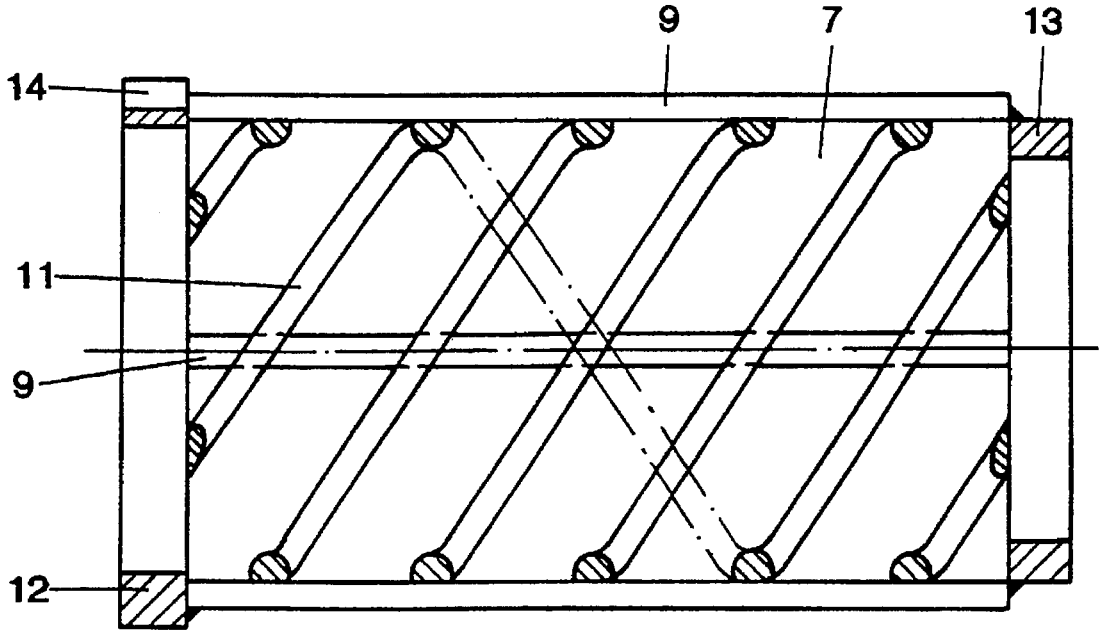
FIG. 6 is a longitudinal section of a cage-like embodiment of an insert.
Figure 8:
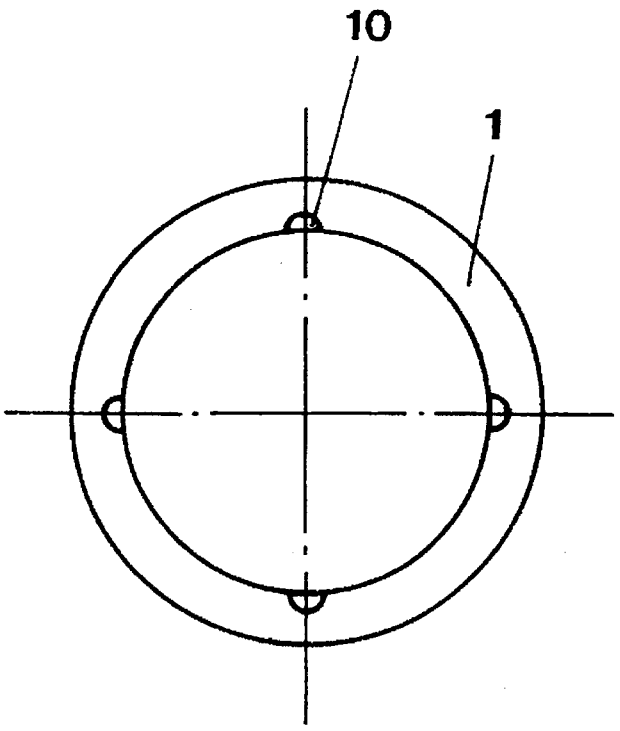
FIG. 8 is a cross-sectional view of the barrel of FIG. 7.

FIG. 6 depicts a barrel insert 2 which resembles a cage. It is formed of helically extending staves 11 preferably made of high-grade stainless steel, which at their ends are fastened to rings 12;13. Metal strips 9, extending between, and connected to, the rings 12; 13 as well as to the staves 11 at their outside, impart necessary rigidity to the insert 2. As may be seen FIG. 6, the cage-like structure is dimensioned such that its outer diameter corresponds to the inner diameter of the barrel of a meat grinder housing. When in enegagement with the interior wall of the housing, the helically wound staves 11 impart the axial guidance or stabilization effect to any material necessary for its grounding or cutting, in the manner of the grooved structures described supra. In the manner discussed supra in connection with FIG. 5, the strip 9, when seated within a groove 10 in the interior wall of the barrel 1, also secures the insert 2 against rotational movement when mounted within a barrel 1.

Figure 7:
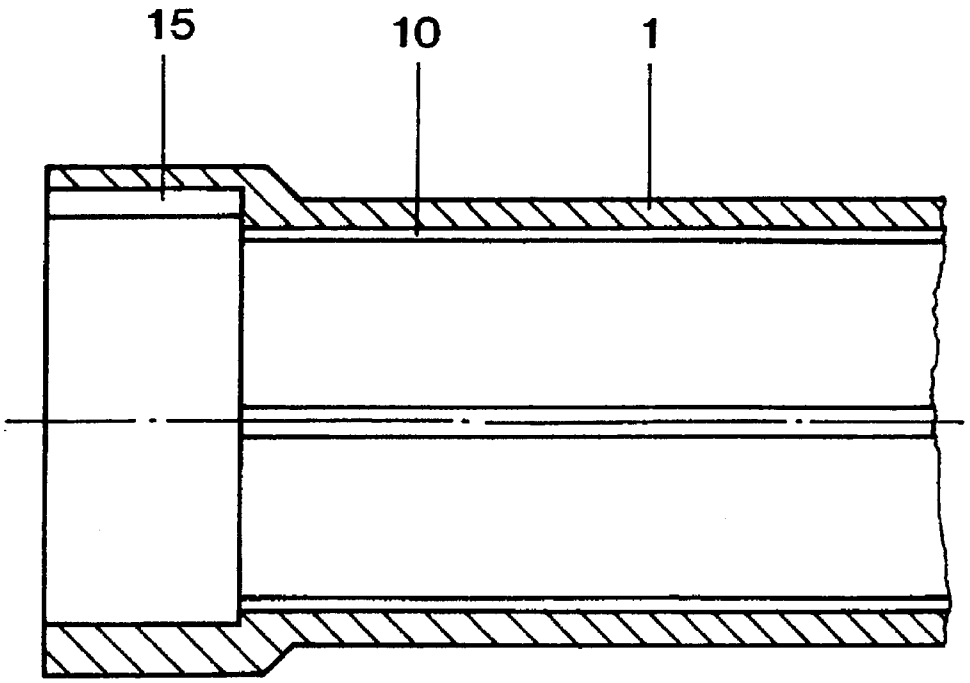
FIG. 7 is a view, in longitudinal section, of a pressure barrel.

The insert 2 may also be secured against rotational movement by providing a groove 14 in the forward ring 12, which receives a feather 15 (FIG. 7) provided in the barrel 1 for securing parts of the cutter assembly against rotation.

Removal of the insert 2 from the barrel 1 takes place either in the manner earlier described or simply by grabbing the forward ring 12 and pulling the insert 2 from the barrel 1.

In their disassembled condition the insert 2 as well as the barrel 1 may be cleaned easily. No residue of any kind will remain in or on the components. Such perfect cleanability accommodates modern standards of hygiene and health regulations.

Such standards are also accommodated by a meat grinder comprising a barrel 1 made of high-grade stainless steel and made from a web material provided with beads and shaped into a cylindrical body.

The orientation or inclination of the channels 16 resulting from the forming of the barrel 1 are circumferentially spaced in the barrel, and their cross-sectional configuration corresponds to the beads formed in the web before forming it into the substantially cylindrical barrel shape.

The channels shown are of a rounded trapezoidal cross-sectional which has proven to be advantageous for material feed as well as cleaning of the apparatus.

The channels 16 may extend in a straight configuration, or they may be extending helically; they terminate in front of the cutter assembly of a meat grinder.

Figure 10:
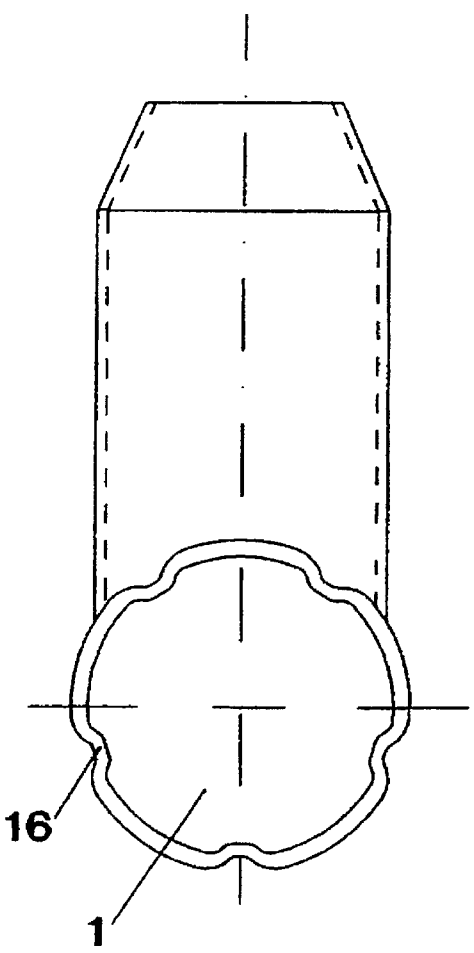
FIG. 10 is a frontal view of the body shown in FIG. 9.
Figure 9:
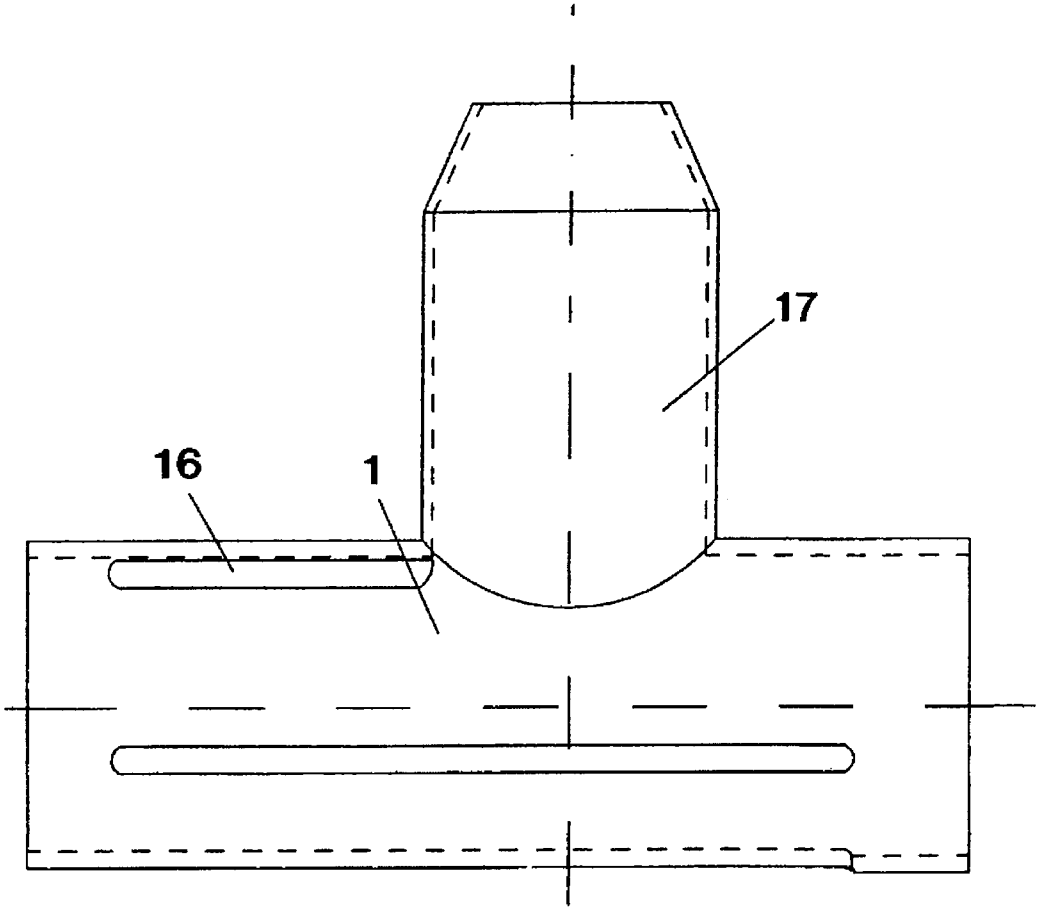
FIG. 9 is a schematic side view the basic body including a hopper.

FIG. 9 and 10 depict an arrangement of a hopper 17 on a barrel 1 which was found to be of particular advantage in small meat grinders.

Preferably, the beads or protrusions and, commensurately, the channels herein described, whether of straight or helical configuration, are of uniform height and width and uniformly spaced from each other. In special circumstances, they may, however, be tapered in the same direction, or the tapering may alternate between adjacent protrusions or channels.

It will be understood by those skilled in the art that certain changes and modifications may be made in any of the embodiments herein described, without departing from the scope or spirit of the invention. It is, therefore, intended that all matter herein described is to be interpreted as being exemplary only, and in no way limiting the scope of protection sought.

What is claimed is:

1. A pressure barrel for use in a meat grinder of the kind comprising a housing defining a cavity of predetermined cross-sectional configuration and length, comprising:

support means defining a passage and adapted to be removably mounted within said cavity substantially coaxially therewith, said support means comprising body means formed by at least one substantially flat web means bent into a configuration having an outer cross-sectional contour and an overall length substantially corresponding to said configuration and length, respectively, of said cavity and being provided with a plurality of elongate members radially spaced from the axis of said passage and forming between them grooves extending over the entire length of said passage.

2. The pressure barrel of claim 1, wherein said body means is made from high-grade stainless steel containing a metal from the group comprising chromium, titanium and nickel.

3. The pressure barrel of claim 2, wherein said outer cross-sectional contour defines an interior wall and said elongate members comprise protrusions formed in said interior wall.

4. The pressure barrel of claim 3, wherein said protrusions comprise beads cold formed in said flat web prior to its being shaped into said outer cross-sectional contour.

5. The pressure barrel of claim 3, wherein said grooves are substantially rectangular cross-section.

6. The pressure barrel of claim 3, wherein said grooves are substantially trapezoidal cross-section.

7. The pressure barrel of claim 3, wherein said grooves are of uniform depth.

8. The pressure barrel of claim 3, wherein said are of uniform width.

9. The pressure barrel of claim 2, wherein said elongate members are aligned in parallel relationship.

10. The pressure barrel of claim 9, wherein said elongate members are of uniform height.

11. The pressure barrel of claim 9, wherein said elongate members are of uniform width.

12. The pressure barrel of claim 9, wherein said elongate members are aligned in parallel relationship to the longitudinal axis of said body means.

13. The pressure barrel of claim 9, wherein said elongate members extend helically around the longitudinal axis of said body means.

14. The pressure barrel of claim 2, wherein said housing comprises key means and said body means comprises means adapted to mate therewith.

15. The pressure barrel of claim 7, wherein said key means comprises a feather and said mate means comprises a groove.

16. The pressure barrel of claim 9, wherein said key means comprises channel means in said cavity and said mate means comprises a strip radially protruding from and axially extending along said body means.

17. The pressure barrel of claim 2, wherein said web means comprises comprising first and second sections being bent into complementary shapes together forming said outer cross-sectional contour defining an interior wall with said elongate members therein.

18. The pressure barrel of claim 17, wherein said cavity is provided with elongate groove means and at least one of said shell means is provided with radially protruding strip means for mating with said elongate groove means.

19. The pressure barrel of claim 1, wherein the outer diameter of said body member substantially matches the inner diameter of said cavity.

20. The pressure barrel of claim 1, wherein the outer diameter of said body member is less than the inner diameter of said cavity to form an annular gap therebetween.

21. A pressure barrel for use in a meat grinder of the kind comprising a housing defining a cavity of predetermined cross-sectional configuration and length, comprising:

support means defining a passage and adapted to be removably mounted within said cavity substantially coaxially therewith and comprising first and second ring means in coaxial alignment with each other and having an outer cross-sectional contour complementing said cross-sectional configuration, and a plurality of stave means of uniform length connected at their ends to said first and second ring means at substantially equal spacings from each other for forming body means of a length substantially equal to said predetermined length.

22. The pressure barrel of claim 21, wherein said stave means are aligned in parallel to each other and to the longitudinal axis of said body means and at substantially equal distances therefrom.

23. The pressure barrel of claim 21, wherein said stave means are aligned in parallel to each other and are disposed helically around the longitudinal axis of said body means at substantially equal distances therefrom.

24. The pressure barrel of claim 21, wherein said cavity and said body means are provided with complementary key means.

25. The pressure barrel of claim 21, wherein said stave means are of uniform gage.

26. The pressure barrel of claim 21, wherein said stave means are connected to said ring members substantially flush with the outer periphery thereof.

* * * * *